US005268046A

United States Patent [19]

Cline

[11] Patent Number: 5,268,046

[45] Date of Patent: Dec. 7, 1993

[54] SURFACTANT STABILIZED NITROGLYCERIN EMULSION

[75] Inventor: Philip E. Cline, Greensboro, N.C.

[73] Assignee: Hercules Incorporated, Wilmington, Del.

[21] Appl. No.: 930,128

[22] Filed: Aug. 14, 1992

[51] Int. Cl.[5] ..... C06B 25/10

[52] U.S. Cl. ..... 149/101; 252/312

[58] Field of Search ..... 149/101; 252/312

[56] References Cited

U.S. PATENT DOCUMENTS

| | | | |
|---|---|---|---|
| 3,231,437 | 1/1966 | Berthmann et al. | 149/101 |
| 3,926,862 | 12/1975 | Figiel et al. | 252/545 |
| 4,014,655 | 3/1977 | Brunnberg | 23/266 |
| 4,417,025 | 11/1983 | Toba et al. | 525/54.21 |
| 4,594,118 | 6/1986 | Curtin et al. | 149/2 |
| 4,654,209 | 3/1987 | Leslie et al. | 424/80 |
| 4,767,476 | 8/1988 | Gebauer | 149/109.6 |
| 4,970,248 | 11/1990 | Tanner | 524/94 |
| 5,011,874 | 4/1991 | Hoppe et al. | 524/30 |
| 5,120,375 | 6/1992 | Mullay et al. | 149/2 |

OTHER PUBLICATIONS

Vasconcelos, *Chem. Abs.*, Abs. #74,704x, vol. 115 (No. 8) Jan. 1991. (Brazil 9004405 A).

*Primary Examiner*—Edward A. Miller

*Attorney, Agent, or Firm*—James K. Luchs

[57] ABSTRACT

A non-detonable nitroglycerin emulsion which does not settle in the absence of agitation incorporates an aqueous phase containing at least 5.0% by weight of an alkyl aryl emulsifying agent. Preferred amine salts of alkyl aryl sulfonates with a 11.7 HLB value can emulsify nitroglycerin, nitroglycol, nitrocellulose and trinitrotoluene. Stable emulsions with a water:nitroglycerin volumetric ratio between 2:1 to 3:1 most preferably incorporate the isopropylamine salt of dodecylbenzene sulfonate.

12 Claims, No Drawings

SURFACTANT STABILIZED NITROGLYCERIN EMULSION

This invention was made with U.S. Government support under Contract No. DAAA09-86-Z-0003 awarded by the Department of the Army. The Government has certain rights in this invention.

FIELD OF THE INVENTION

The invention relates to explosive and propellant materials requiring safe handling prior to use. In particular, the invention relates to a storage-stable nitroglycerin emulsion.

BACKGROUND OF THE INVENTION

U.S. Pat. No. 3,231,437 discloses a detonable water-in-oil emulsion comprising nitroglycerin and an ionic emulsifier and a stabilizer such as collodion-cotton. These nitroglycerin emulsions were reported to be safe in transport or storage using about 1% by weight ionic emulsifier such as sodium cetyl sulphate, magnesium oleate, calcium stearate and zinc stearate.

U.S. Pat. No. 4,767,476 discloses a process and device for temporary storage of oil-in-water nitroglycerin emulsions. A disadvantage of this system was a continuing need to provide agitation to avoid the settling out of drops of nitroglycerin from the emulsion.

U.S. Pat. No. 5,120,375 discloses an aqueous explosive composition in which ammonium nitrate is emulsified with a surfactant from the group of sorbitan monooleate, polyisobutylene succinic anhydride and hydrogenated tallow amine. In particular, it was disclosed that particles of ammonium nitrate with acid sites on the surface are substantially neutralized by basic groups on the surfactant during the production of stable emulsions. Determination of both type and the amount of surfactant to produce emulsification required actual experimental testing, since theory was unable to predict what was or was not satisfactory for emulsification. In addition, the emulsification of the explosive component these water-in-oil and melt-in-fuel emulsion explosives further comprised a cushioning agent such as cork or balsa to reduce predetonation sensitivity.

Hydrophile-Lipophile Balance (HLB) is a numerical method to characterize surfactants based on the size and length of the hydrophilic and lipophilic groups of the surfactant/emulsifier and was developed by ICI Americans Inc. (Wilmington, Del.). According to the theory involved, all surfactants with similar HLB values will have similar hydrophilic and lipophilic characteristics. Thus HLB value can be used to screen surfactants or emulsifiers once a desired effect has been observed.

The HLB system: A Time-Saving Guide to Emulsifier Selection. ICI Americas Inc., Wilmington, Del., 1976 provides a complete description of the Hydrophile-Lipophile Balance (HLB) system of surfactant selection including guidelines for tests to determine the required HLB value for a given system to be emulsified.

Yet despite what was known in the art, a need still existed for an oil-in-water explosive emulsion which remained stable for 24 hours or more without agitation.

SUMMARY OF THE INVENTION

It is an object of the invention to provide a stable non-detonable aqueous oil-in-water emulsion comprising a primary explosive selected from the group of nitroglycerin, nitroglycol, nitrocellulose and trinitrotoluene; and at least 5.0% by weight based on the total weight of the aqueous phase at least one ionic emulsifying agent having a Hydrophile-Lipophile Balance (HLB) value of 10–12.

It is preferred that the emulsion comprise nitroglycerin and the isopropylamine salt of dodecylbenzene sulfonate wherein the water:nitroglycerin volumetric ratio is between 2:1 to 3:1 and nitroglycerin micelles range in size between about 5 to 50 μm.

A preferred process for preparing a storage-stable, aqueous, non-detonable nitroglycerin emulsion comprises the steps:

(1) preparing a solution of an isopropylamine salt of dodecylbenzene sulfonate;

(2) mixing the solution with nitroglycerin to prepare an emulsion with 5 to 50 μm nitroglycerin micelles; and (3) storing the emulsion without agitation until required for further use or processing.

A process for recovering the nitroglycerin comprises the steps:

(1) emulsifying nitroglycerin in water with an ionic emulsifying agent having an HLB value of 10–12;

(2) storing the aqueous emulsion in the absence of agitation;

(3) adding a demulsifying agent to break the emulsion; and (4) processing the demulsified explosive to recover the nitroglycerin in a form suitable to prepare a propellant.

DETAILED DESCRIPTION OF THE INVENTION

Explosive and propellant compositions and preparations require very exacting handling and storage requirements. Prevention of premature detonation and ignition is a continuing goal for all who are involved in safely storing and handling such materials. As such the advance provided by the present invention satisfies a continuing need.

It has been discovered that a novel, aqueous, non-detonable nitroglycerin emulsion allows the elimination of agitation in storage containers. A much simpler and thus cost effective system can be employed without sacrifice of safety requirements with the availability of an emulsion which does not allow the nitroglycerin or other suitable primary explosive or mixture thereof to settle out over extended periods of time.

ATLAS® G-3300 ionic salt surfactant (emulsifier) is an isopropylamine salt of dodecylbenzene sulfonate. This ionic salt dissociates in water with the isopropylamine cation being completely soluble in water while the dodecylbenzene sulfonate molecules form spherical micelles which surround and stabilize nitroglycerin droplets. As a result a double charge layer is formed with a diffuse layer of positive charge around the negatively charged micelles.

It was originally determined that the surfactant HLB value required for stabilization without agitation was in the 10–12 range. ATLAS® G-3300 isopropylamine salt of dodecylbenzene sulfonate with a 11.7 HLB value is the most preferred emulsifier. The emulsifier must be present in a concentration of at least 5.0% by weight based on the total weight of the aqueous phase in nitroglycerin oil-in-water emulsions.

According to McCutcheon's Emulsifiers and Detergents, North American Edition, 1983, there are at least 20 generic chemical names for ionic surfactant/emulsifiers which have HLB values from 10 to 12. However, in addition to ICI there are at least a dozen other companies which offer amine salts of alkyl aryl sulfonates having a 11.7 HLB value when such a value is listed. While it is not known with certainty, it is believed that alternate sources are available for emulsifying agents useful for practice of the present invention. It was found that satisfactory emulsions could not be produced with surfactants having an exact 11.7 HLB value such as ethoxylated castor oil, nonylphenoxy polyethoxy ethanol, polyethylene glycol monooleate and polyethylene glycol dilaurate. The surfactant/emulsifier types described in U.S. Pat. Nos. 3,231,437 and 5,120,375 were among the ones tested in a screening program to determine suitable candidates for further evaluation. All surfactant/emulsifier types described in these and other prior art references were rejected after the initial evaluation as described below in Procedure A, with the exception of alkyl aryl sulfonates.

In preparing nitroglycerin aqueous emulsions according to the present invention, droplet size for maximizing stability with the HLB 10–12 ionic emulsifiers should be in the size range of 5 to 50 μm. The use of photomicrographs is a convenient way of checking that droplet size falls within these parameters.

While nitroglycerin is the preferred material for use with the present invention, other useful materials which can similarly be emulsified in the form of 5 to 80 μm micelles are: nitroglycol, nitrocellulose and trinitrotoluene.

The storage-stable emulsions of the invention can be used for liquid, solid, or gelled explosive or propellant compositions. Nitroglycerin from these emulsions can be blended with other liquid and solid explosives to prepare explosive and propellant compositions with varying explosive power and shock sensitivity. Lead azide and mercury fulmerate are preferred detonators for use with explosive compositions.

The nitroglycerin emulsions of the invention may be demulsified and combined with a polymer in the preparation of a propellant. Nitrocellulose is the preferred polymer for such propellants.

The invention has industrial applicability for explosives and propellants. The following Procedures and Examples illustrate the invention without being limiting.

PROCEDURE A

Laboratory Emulsification Tests

Laboratory emulsification tests were performed by adding standard samples of nitroglycerin to a 50 ml plastic centrifuge tube. Each test used 5.0 ml of nitroglycerin and 5.0 ml of an aqueous test solution of surfactant/emulsifier. A polyethylene sparging tube was used to provide agitation to the system. Compressed air was used as the sparging medium. Agitation was continued for 5 minutes at the maximum rate possible without splashing. Surfactants were evaluated using aqueous stock solutions of 0.1 and 1.0 weight percent. Observations were made on degree of emulsification and foaming.

PROCEDURE B

Bench-Scale Emulsification Tests

Due to problems of foaming and inadequate shear force associated with air sparging used during Procedure A, a mechanical agitation method was devised for bench-scale testing. Agitation was performed remotely and video cameras were used to observe the mixing in order to increase operator safety. Stable non-detonable emulsions were created in a constant temperature bath at 78° F.; a pressure of 14 psig was supplied to an air motor equipped with a two-bladed, marine-type impeller to give an approximate speed of 3,000 rpm. Agitation was continued for 3 minutes. All tests used 6.3 ml of nitroglycerin in 1:1, 2:1 and 3:1 volumetric ratios with stock solutions at 1, 2, 5 and 10% concentrations of surfactant. The water used to prepare the stock solutions had a pH of 8.6, total hardness of 0 mg/l, calcium hardness of 0 mg/l and sodium content of 30 mg/l.

PROCEDURE C

Micelle Size Determinations

Micelle size for both aqueous surfactant and emulsified nitroglycerin was measured from 100 X and 500 X magnification photographs from a laboratory microscope. On the basis of these observations it was possible to determine that 5 to 50 μm micelle size was required for optimum emulsion stability. Stable emulsions could not be produced with micelles in the 80 to 100 μm size range.

PROCEDURE D

Demulsification

Stable emulsions produced as in Procedure B were tested with salt solutions. To 18.9 ml of emulsion, 18.9 ml addition of a 5 weight percent salt solution was made and flocculation was observed. Satisfactory performance was judged from an observation that flocculation occurred immediately upon addition and the contents within an emulsion tube separated into three layers with a white flocculate forming both the top and bottom layers with a clear water layer in the middle.

PROCEDURE E

Centrifuge Recovery

Flocculated samples obtained from Procedure D were placed in centrifuge tubes and centrifuged for 2 minutes at 3,200 rpm (1,286×G). Two distinct liquid phases could be observed separated by a thin, semi-solid, white material after centrifuging the demulsified nitroglycerin. The bottom nitroglycerin phase was clear and slightly yellow while the top aqueous phase was clear and colorless.

EXAMPLE 1

Using Procedure B an oil-in-water emulsion was produced using 6.3 ml (19 g) of nitroglycerin and 12.6 ml of an aqueous stock solution containing 5.1 weight percent of ATLAS® G-3300 surfactant/emulsifier (available from ICI, Wilmington, Del.) an isopropylamine salt of dodecylbenzene sulfonate. Once prepared the nitroglycerin emulsion was unstirred. After 117 hours, no drops of nitroglycerin were present in the bottom of the container and no solution coalescence had occurred.

EXAMPLE 2

Example 1 was repeated except that 18.9 ml of stock solution was used. After 24 hours, no drops of nitroglycerin were present in the bottom of the container and no solution coalescence had occurred.

EXAMPLE 3

Example 1 was repeated except that a 4.0 weight percent stock solution was used. After 24 hours, droplets of nitroglycerin were found in the bottom of the container but no solution coalescence had occurred.

From this it was concluded that at least 5.0 weight percent emulsifying surfactant based on the total weight of the aqueous phase was required to produce storage-stable aqueous emulsions.

EXAMPLE 4

Example 1 was repeated except a 5% solution of sodium oleate was used. After 52 hours droplets of nitroglycerin were found in the bottom of the container, but solution coalescence had not occurred.

EXAMPLE 5

Using Procedure A approximately 30 surfactant and combinations thereof were tested for possible use as nitroglycerin emulsifiers. As a result of these screening tests it was determined that a HLB value of 10–12 would be required for fully satisfactory emulsification of nitroglycerin.

EXAMPLE 6

Using Procedure B ATLAS® G-3300 (HLB 11.7) surfactant was compared with 19 other surfactants having HLB values ranging from 10.2 to 12.4. Certain of these surfactants had HLB values of exactly 11.7, but none of these was an alkyl aryl sulfonate or salt thereof. The isopropylamine salt of dodecylbenzene sulfonate was superior to all other surfactants tested. It was determined that not all surfactants within this HLB range would emulsify nitroglycerin. Thus the only way to confirm that a surfactant was even partially satisfactory was by actual testing after an initial screening program.

EXAMPLE 7

Nitroglycerin emulsions having water:nitroglycerin ratios of 2:1 to 3:1 were prepared using an aqueous phase containing at least 5.0% by weight isopropylamine salt of dodecylbenzene sulfonate. These emulsions were stored in unstirred containers for observation and evaluation.

This illustrates the reduction to practice for full scale employment of this invention in which stirring required for prior art emulsion storage could be eliminated.

EXAMPLE 8

Emulsions prepared as in Example 7 were demulsified using Procedure D with a 5% by weight solution of calcium chloride. Nitroglycerin suitable for propellant preparation was then recovered using Procedure E.

COMPARATIVE EXAMPLE 9

Emulsions were prepared containing 1% by weight surfactant as described in U.S. Pat. No. 3,231,437 and the nitroglycerin emulsions were stored in stirrer equipped tanks as described in U.S. Pat. No. 4,767,476. Settling of drops of nitroglycerine was observed within 24 hours if the stirring was stopped.

COMPARATIVE EXAMPLE 10

Example 4 was repeated except that various combinations of sodium oleate and carboxymethylcellulose were used in an attempt to obtain satisfactory storage-stable emulsions in comparison with Example 7. No combinations tested were found to be better than the use of sodium oleate by itself.

Comparative Examples 9 and 10 illustrate that it was not possible to use past technology to obtain results comparable with the present invention. The present invention was possible only by a radical departure from prior art techniques and formulations.

I claim:

1. A non-detonable emulsion consisting essentially of water, nitroglycerine and an effective amount of an alkyl aryl sulfonate emulsifying agent.

2. The emulsion of claim 1 wherein the alkyl aryl sulfonate emulsifying agent has a Hydrophile-Lipophile Balance (HLB) value of 10–12.

3. The emulsion of claim 2 wherein the HLB value is 11.7.

4. The emulsion of claim 1 wherein the emulsifying agent is the isopropylamine salt of dodecylbenzene sulfonate.

5. The emulsion of claim 4 wherein the water:nitroglycerin volumetric ratio is between about 2:1 and 3:1.

6. The emulsion of claim 5 consisting essentially of nitroglycerin micelles in the size range of about 5 to 50 μm.

7. The emulsion of claim 6 wherein in the absence of agitation the emulsion remains stable for a period of at least 24 hours.

8. The emulsion of claim 7 wherein an aqueous phase comprises at least 5.0% by weight of the isopropylamine salt of dodecylbenzene sulfonate.

9. An aqueous nitroglycerin emulsion consisting essentially of water and nitroglycerine stabilized with an ionic surfactant, wherein the emulsion is an oil-in-water emulsion stable without repeated agitation and the surfactant is the isopropylamine salt of dodecylbenzene sulfonate present in an effective amount.

10. The emulsion of claim 9 wherein the water:nitroglycerin volumetric ratio is between about 2:1 and 3:1.

11. The emulsion of claim 10 consisting essentially of nitroglycerin micelles in the size range of about 5 to 50 μm.

12. The emulsion of claim 11 consisting essentially of at least 5.0% by weight of the isopropylamine salt of dodecylbenzene sulfonate.

* * * * *